United States Patent [19]

Campora et al.

[11] Patent Number: 4,794,400

[45] Date of Patent: Dec. 27, 1988

[54] ANGULAR-DIVERSITY RADIATING SYSTEM FOR TROPOSPHERIC-SCATTER RADIO LINKS

[75] Inventors: Carlo Campora, Genoa; Elio Deponti, Vaprio D'Adda, both of Italy

[73] Assignee: GTE Telecommunicazioni, S.p.A., Milan, Italy

[21] Appl. No.: 99,365

[22] Filed: Sep. 21, 1987

[30] Foreign Application Priority Data

Sep. 22, 1986 [IT] Italy ..... 21777 A/86

[51] Int. Cl.[4] ..... H01Q 3/12

[52] U.S. Cl. ..... 343/761; 343/758; 343/776; 343/880

[58] Field of Search ..... 343/758, 761, 776, 779, 343/880

[56] References Cited

U.S. PATENT DOCUMENTS 3,988,736 10/1976 Smith et al. ..... 343/779

4,529,990 7/1985 Brunner ..... 343/779

OTHER PUBLICATIONS

Effect of Angle Diversity in Troposcatter Communication System; S. Morita; NEC Research & Development. No. 45, pp. 83–93, Apr. 1977.

*Primary Examiner*—William L. Sikes

*Assistant Examiner*—Robert E. Wise

*Attorney, Agent, or Firm*—David N. Caracappa

[57] ABSTRACT

An angular-diversity radiating system is described for tropospheric-scatter radio links which comprises a paraboloid and two antenna horns in which the distance between the antenna horns is adjustable in order to vary the diversity angle depending on the transmissive characteristics of the troposphere of the link involved to always have the optimal diversity angle under all link conditions.

The radiating system includes four wave guides connected to the two antenna horns to permit the use of single and double polarization for both the antenna horns and the use of both the antenna horns, or alternatively only one, for receiving and transmitting signals.

8 Claims, 3 Drawing Sheets

ANGULAR-DIVERSITY RADIATING SYSTEM FOR TROPOSPHERIC-SCATTER RADIO LINKS

BACKGROUND OF THE INVENTION

1. Field of Invention

The present invention relates to the field of tropospheric scatter radio links and more particularly to a radiating system with angular diversity comprising an antenna reflector, at least a first and a second antenna horn, and waveguides connected with said antenna horns.

2. Description of the Prior Art

It is known that to establish microwave radio links beyond the horizon it is possible to use radiating systems which utilize the scattering of electromagnetic waves by the troposphere.

It is also known that the troposphere displays irregularities generally considered as bubbles or layers which vary continuously in number, form and position with resulting variation of the refraction index and diffusion angle. When such irregularities are illuminated by a beam of electromagnetic waves from a transmitting antenna they scatter the electromagnetic energy in all directions but predominantly within a cone having as its axis the direction of transmission.

It is clear that with such link path attenuation is much higher than that found in links with antennas which remain in a field of mutual visibility since the propagation mechanism is different. In addition, in troposcatter radio links there are met sudden deep fadings of the intensity of the signal received due mainly to random movements of the troposphere layers.

Diversity techniques are known which are used to avoid the aforementioned problems with tropospheric propagation, i.e. spatial, frequency, polarization and angular diversity, for the purpose of increasing the reliability of the link.

Spatial diversity consists of transmitting the same signal with two antennas appropriately spaced and directed and in using two other antennas similarly arranged for reception. The basic assumption on which this technique is based is that fadings of signal intensity which appear on the two beams are poorly correlated.

Frequency diversity differs from spatial diversity in that the signal is radiated on a single beam but with two carriers appropriately spaced in frequency so as to decorrelate intensity fadings of the two signals received.

Polarization diversity consists of radiating the signal on a single beam with two polarizations orthogonal to each other (generally horizontal and vertical) and at the same frequency in such a manner as to decorrelate the fadings of the two signals received.

Angular diversity consists of radiating electromagnetic power in a single beam and in equipping the receiving antenna with two receiving horns appropriately spaced from each other in such a manner that the single transmitted beam is received in two different directions forming a certain angle called diversity angle and giving rise to two signals as independent as possible from the point of view of tropospheric propagation. It is thus possible to effect in reception a combination of the two signals received, such that the combination signal intensity or the signal-to-noise ratio of the combination is always kept sufficiently high.

Combinations of the aforementioned diversity techniques such as, for example, space-frequency and space-polarization, etc . . . diversity are also possible and commonly accomplished.

It is also known that with angular diversity systems there is the problem of optimizing the diversity angle which, as aforementioned, depends on the distance between the receiving horns. As the diversity angle increases so does the statistical independence between the intensity fadings which appear on the two received signals, with a resulting system improvement. But antenna gain is simultaneously reduced because of defocusing. In addition the transmissive characteristics of the troposphere vary dpending on the different climatic zones of the earth so that an optimized diversity angle for a given place is inapplicable in another. These drawbacks become even more serious for mobile antennas which are moved from one place to another. Frequently and for which the optimal diversity angle is consequently nearly never obtained.

An angular diversity radiating system is described in the article of Sigheru Morita, Hiroki Tachibana, Toshinari Hoshino and Hitoshi Kawasaki entitled "Effect of Angle Diversity in Troposcatter Communication System" published in Nec Research & Development, No. 45, pages 83–93, April 1977.

The Morita, et al system accomplishes angular diversity by means of two double-polarization horns both capable of transmitting and receiving or by means of two antenna horns of which the first, with double polarization, is used both to transmit and receive and the second, with single polarization, is used only for receiving.

The main drawbacks met with in the Morita, et al system are the consequence of the fact that it is not possible to optimize the diversity angle in relation to the site where the system is installed and of the fact that the horn apertures are rectangular, and therefore in double polarization only one polarization can be optimized.

Accordingly the object of the present invention is to overcome the drawbacks described hereinbefore and provide an angular-diversity radiating system which provide permits optimization of the diversity angle for the place where the system is installed.

SUMMARY OF THE INVENTION

The object of the present invention is an angular-diversity radiating system comprising an antenna reflector, at least a first and a second antenna horn, and wave guides connected with the antenna horns, and includes means for adjusting the distance between the first and second antenna horn.

Further purposes and advantages of the present invention will be made clear by the following detailed description of a preferred but not limiting embodiment example thereof, and with reference to the drawings wherein:

DESCRIPTION OF THE PREFERRED EMBODIMENT

Figure 1:
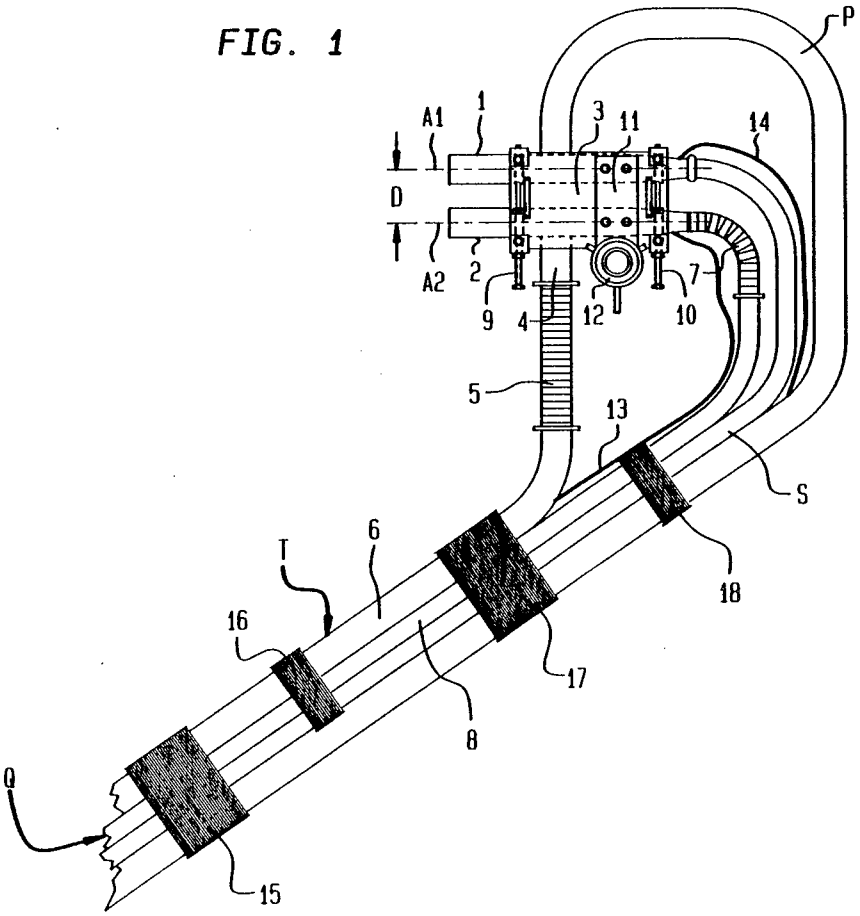
FIG. 1 shows a partially interrupted side view of the angular-diversity radiating system of the present invention.

With reference to FIG. 1 a first antenna horn 1 and a second antenna horn 2 located under the first horn 1, are both connected with a fixing plate 3. The antenna horns 1 and 2 have longitudinal symmetry axes A1 and A2 which are spaced distance D apart and are parallel to the optical axis of an antenna reflector (not shown). The radiating aperture center of the antenna horn 1 coincides with the focus of the antenna reflector.

The antenna horn 1 is connected to a first rigid wave guide P having a rectangular cross section and with a second rigid wave guide S having a rectangular cross section.

The antenna horn 2 is connected with a third wave guide T having rectangular cross section composed of a rigid length 4, followed by an elastic length 5 and a rigid length 6 and a fourth wave guide Q having rectangular cross section composed of an elastic length 7 followed by a rigid length 8.

The four wave guides P, S, T and Q are held together by a number of bands 15, 16, 17 and 18 consisting of glass cloth strips impregnated with resin.

In the lower left and right corners of the fixing plate 3 there are two adjusting screws 9 and 10.

On the surface of the fixing plate 3 are fixed a plate 11 and a threaded ring nut 12 for connection of two side stays or guys (not visible in the figure) which permit positioning of the antenna horn 1 in the focus of the parabolic antenna reflector.

Two electric cables 13 and 14 supply resistances through a switch (not shown in the figures) wrapped around the two antenna horns 1 and 2 to heat them if necessary in order to prevent the formation of ice.

Figure 2:
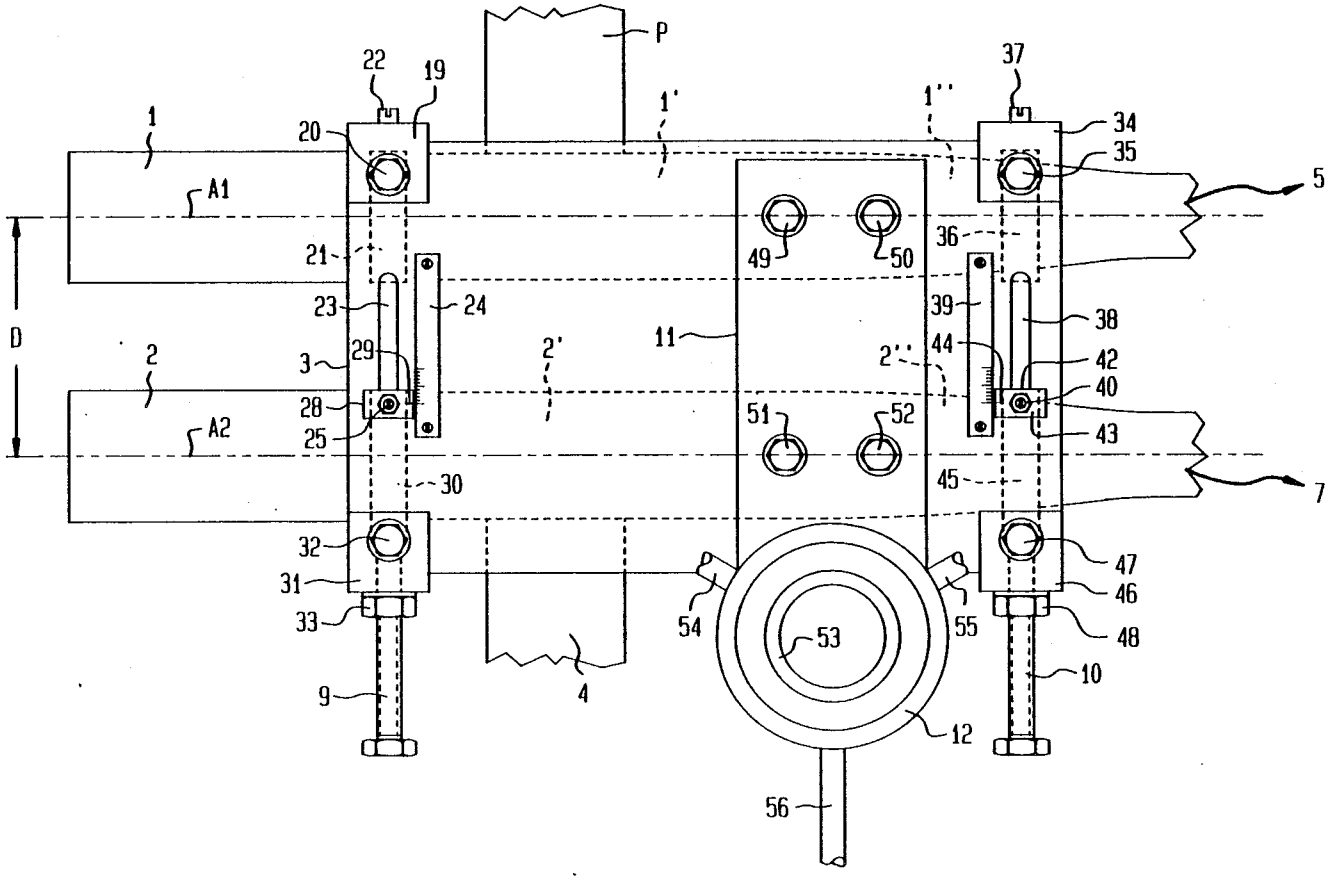
FIG. 2 shows a partially interrupted detailed side view of a detail of FIG. 1.
Figure 3:
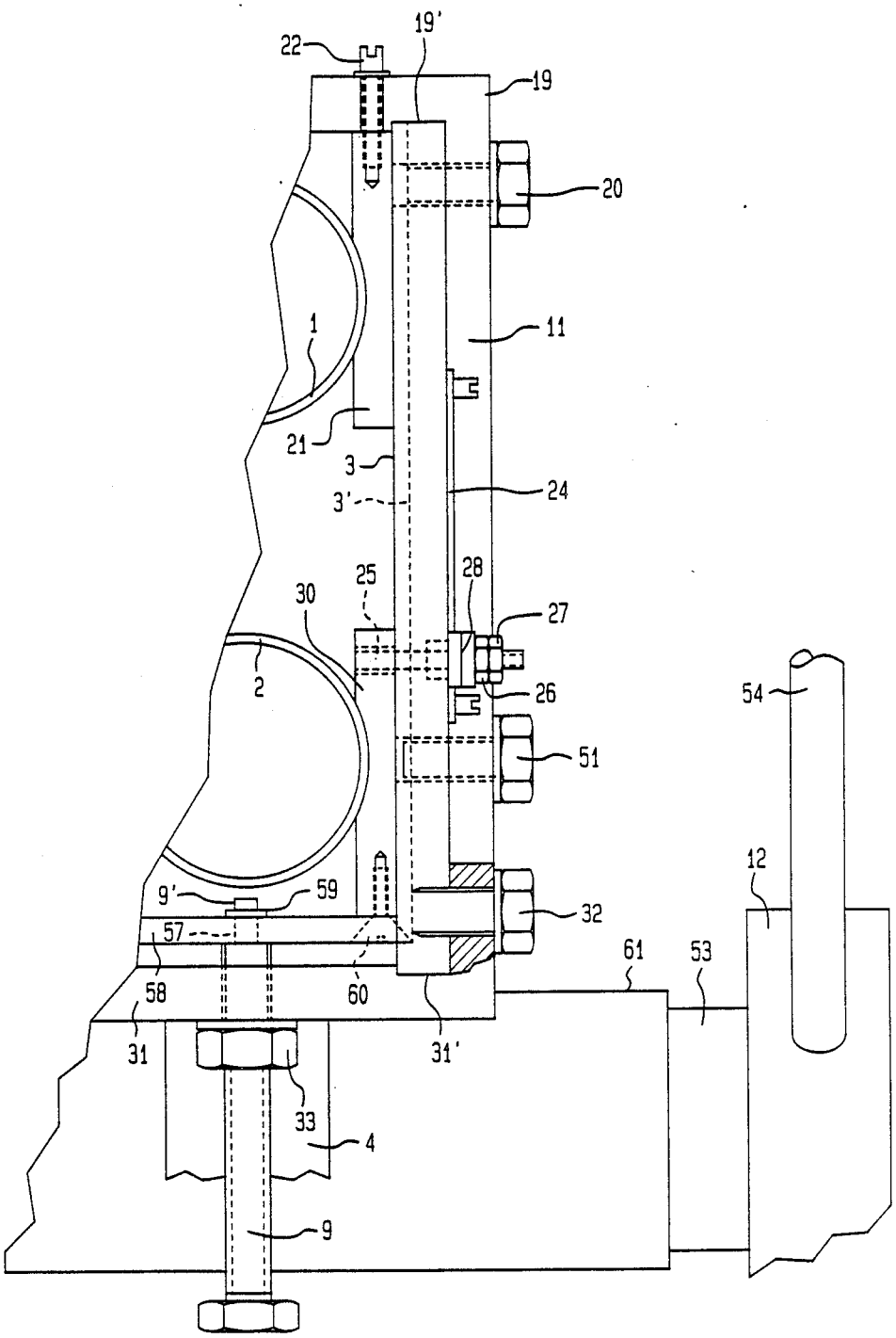
FIG. 3 shows a partially interrupted detailed front view of said detail of FIG. 2.

With reference to FIGS. 2 and 3, which show the fixing system of the horns in a side view and a front view from the side of the antenna horns and in which the same components of FIG. 1 are indicated with the same numbers, it can be seen that the antenna horns 1 and 2 are formed of two parts having different cross sections. The first part 1' of the antenna horn 1 has a constant circular cross section and is connected to the wave guide P while the second part 1" has a variable cross section. Starting from the left and moving toward the right the circular cross section is transformed progressively into a rectangular cross section which is connected to the wave guide S. The first part 2' of the antenna horn 2 has a constant circular cross section and is connected to the rigid section 4 of the wave guide T while the second part 2" of the antenna horn 2 has a variable cross section. Moving from the left toward the right the circular cross section is transformed progressively and ends in a rectangular cross section which is connected to the elastic length 7 of the wave guide Q.

On the upper left corner of the fixing plate 3 there is a jaw 19 with in its center a hexagonal-head screw 20, a block 21 and a screw 22 placed over the jaw 19.

On the left side of the fixing plate 3 in a central position there is a travel recess 23 beside which there is fixed a millimetric rod 24. In the recess 23 is inserted a stud bolt 25 connected with a nut 26, a lock nut 27, a plate 28 having an engraved reference notch 29, and a block 30.

On the lower left corner of the fixing plate 3 there is a jaw 31 with in its center a hexagonal-head screw 32. With the jaw 31 is connected an adjusting screw 9 which is in turn connected with a lock nut 33 and whose terminal part 9' is not threaded and has a diameter smaller than the rest of the screw 9.

On the upper right corner of the fixing plate 3 there is a jaw 34, a hexagonal-head screw 35, a block 36 and a screw 37 placed over the jaw 34.

On the right side of the fixing plate 3 in a central position there is a travel recess 38 beside which is fixed a millimetric rod 39. In the recess 38 there is inserted a stud bolt 40 connected to a nut 41 (not visible in the figures), to a lock nut 42 and to a plate 43 having an engraved reference notch 44, and to a block 45.

On the lower right corner of the fixing plate 3 there is a jaw 46 with in its center a hexagonal-head bolt 47. To the jaw 46 there is connected an adjusting screw 10 which is connected to a lock nut 48 and whose terminal part is not threaded and has a diameter smaller than the rest of the screw 10.

The plate 11 is connected to the fixing plate 3 by means of four hexagonal-head bolts 49, 50, 51 and 52 and is welded in its lower part to a tube 61 in which is inserted a pin 53 connected to the threaded ring nut 12 which bears on its exterior three spokes 54, 55 and 56 used for clamping the ring nut 12 to the threaded part of a side stay (not shown).

The upper jaw 19 has a notch 19' and the lower jaw 31 has a notch 31'. In the notches 19' and 31' there is placed the fixing plate 3. The hexagonal-head screws 20 and 32 fix the jaws 19 and 31 to the fixing plate 3.

At the travel recess 23 the fixing plate 3 has a notch 3' where the blocks 21 and 30 are placed. The block 21 is connected to the jaw 19 through the screw 22 and has in its internal wall a notch with a circular profile where there is placed the front part 1' of the antenna horn 1.

The adjusting screw 9 is screwed to the jaw 31 and the nut 33 locks it when adjustment is completed. The terminal part 9' of the screw 9 penetrates a hole 57 made in a support plate 58. An elastic lock washer 59 is inserted in a notch of said terminal part 9' making the plate 58 integral with the adjusting screw 9.

The support plate 58 is connected by means of the screw 60 to the block 30 which has in its internal wall a recess with a circular profile where there is placed the front part 2' of the antenna horn 2.

The stud bolt 25 is connected to the block 30 and can slide along the recess 23. The plate 28 with reference notch 29 is connected to the screw 25 and is fixed by the nut 26 and the lock nut 27 in such a manner as to permit vertical sliding.

The angular-diversity in reception is obtained with the two antenna horn 1 and 2 since each of the horns creates its own main lobe in the radiation diagram. The directions of the main lobes form together an angle termed the diversity angle which, as is known, increases with the increase of the distance D between the longitudinal symmetry axes A1 and A2 of the antenna horns 1 and 2.

The distance D between the longitudinal axes A1 and A2 of the antenna horns 1 and 2 is adjustable so that the diversity angle can be varied. In particular the antenna horn 1 is connected to the fixing plate 3 with no possibility of sliding vertically since the front block 21 which clamps the first part 1' of the horn 1 is clamped against the respective jaw 99 by said screw 22 and the rear part 1" of the horn 1 is clamped in a similar manner.

The antenna horn 2 is connected to the fixing plate 3 in such a manner as to permit vertical sliding. Distance D is adjusted by means of the adjusting screw 9 which acts on the front part 2' of the antenna horn 2 and the adjustment screw 10 which acts on the rear part 2" of the antenna horn 2. The elastic lengths 5 and 7 of the wave guides T and Q are both connected to the sliding antenna horn 2 and permit vertical movement of the horn 2 without causing stresses on the fixing system of the antenna horns 1 and 2.

With reference to the adjustment means of the distance D placed on the front part 2' of the sliding antenna horn 2 and also to the adjustment means placed on the rear part, it is noted that rotation of the adjustment screw 9 raises or lowers the plate 58 and with it the block 30 and consequently the antenna horn 2. The stud bolt 25, which is integral with block 30, siides in its recess 23 to raise or lower the notch 29 cut in the plate 28 in relation to the scale cut on the millimetric rod 24.

The method of adjustment and optimization of the diversity angle must proceed with the following steps in order.

(1) Calculate the theoretical distance D' between the longitudinal axes of the two antenna horns 1 and 2;

(2) Loosen the two bolts 33 and 48, rotate at the same time the adjustment screws 9 and 10, to adjust the antenna horn 2 at distance D' with the help of the millimetric rods 24 and 39 and of the corresponding reference notches 29 and 44 then tighten the two bolts 33 and 48;

(3) accomplish the tropospheric radio links between the two locations to be linked;

(4) record the intensity of the signal received for the entire duration of a predetermined time interval;

(5) again loosen the two bolts 33 and 48 and adjust the receiving horn 2 at a distance D" slightly smaller or greater than D', tighten the two bolts and adjust the intensity of the signal received for the entire duration of the predetermined time interval;

(6) repeat step (5) several times with decreasing or increasing distances in relation to D'; and (7) select as distance D, which optimizes the diversity angle, the distance which gives the highest average signal intensity during the entire predetermined time interval.

Distance D between the receiving horns 1 and 2 can be adjusted continuously and simply and permits optimization of the diversity angle with extreme precision and simplicity.

The radiating system of the present invention is thus particularly suitable for mobile radiating systems in which the diversity angle must be adjusted and optimized very frequently.

The peculiar form of the antenna horns 1 and 2, which terminate with circular radiating apertures, permits propagation of an electromagnetic signal with single or double polarization while the four wave guides P, Q, S and T permit transmission and reception of signals with both or optionally only one of the two antennas horns 1 and 2. In particular, for the double polarization, there is propagation of two electromagnetic signals polarized linearly on orthogonal planes.

Separation of the two polarizations is effected by the wave guides P and T and the two terminal parts 1" and 2" of the antenna horns 1 and 2. The wave guide P and the rigid length 4 of the wave guide T are connected through holes to the side surfaces of the parts 1' and 2' of the antenna horns 1 and 2 respectively in such a manner that the longest side of the rectangular cross section of the wave guides is parallel to the longitudinal symmetry axes A1 and A2 of the corresponding antenna horn.

The terminal rectangular cross sections of the parts 1" and 2" of the attenna horns 1 and 2 are perpendicular to their longitudinal symmetry axes A1 and A2 and also to the cross sections of the wave guides in the connection zones with the parts 1' and 2', thus permitting separation of the two polarizations on orthogonal planes.

From the description given the advantages of the angular-diversity radiating system of the present invention are clear. In particular, the system permits easy and continuous adjustment of distance D between the longitudinal axes A1 and A2 of the receiving horns 1 and 2 in order to vary and optimize the diversity angle under all link conditions and permits use of single and double polarization.

Additional embodiments of the present invention which will become apparent to persons skilled in the art are included within the spirit and scope of the invention as set forth by the claims appended hereto.

For example, the constant cross section of the first part of the two antenna horns, respectively indicated in the embodiment shown in FIG. 2 with references 1' and 2', can be square, without altering the performances of the system.

What is claimed is:

1. An angular-diversity radiating system comprising:

an antenna reflector, a first and a second antenna horn having a longitudinal symmetry, attached to said reflector such that their longitudinal symmetry axes are parallel to each other and to the optical axis of said antenna reflector and such that the centers of their radiating apertures are near the focus of said antenna reflector;

a first, a second, a third and a fourth rectangular cross-section wave guides; and means for adjusting the distance between said first and said second antenna horn allowing the optimization of the diversity angle of the radiating system;

wherein said first and second antenna horns consist of a first part having a constant cross-section connected to a second part having a continuously varying cross-section;

wherein said second parts of said antenna horns terminate with a rectangular aperture perpendicular to said longitudinal symmetry axis;

wherein said second and fourth wave guides are respectively connected to said rectangular apertures of said antenna horns;

wherein said first and third wave guides are respectively connected to said first parts of said first and second antenna horns in such a way the the longer dimension of said rectangular section of said wave guides is parallel to the respective longitudinal symmetry axes of said antenna horns; and wherein said first and third wave guides are perpendicular to said second and fourth wave guides.

2. An angular-diversity radiating system in accordance with claim 1 wherein said adjusting means includes a first and a second fixing plate connected rigidly together by means of connecting elements to which elements is rigidly connected said first antenna horn and to which elements said second antenna horn is adjustably connected.

3. An angular-diversity radiating system in accordance with claim 2 wherein said adjustable connection between said connecting elements of said fixing plates and said second antenna horn includes screws, bolts and nuts which oonnect said connecting elements to support means of said second antenna horn, allowing the adjustment of the distance between said second antenna horn and said first antenna horn.

4. An angular-diversity radiating system in accordance with claim 1 wherein said first antenna horn is disposed with its longitudinal symmetry axis coinciding with the optical axis of said antenna reflector and with the center of its radiating aperture coinciding with the focus of said antenna reflector.

5. An angular-diversity radiating system in accordance with claim 1 wherein said constant cross section of said first part of said antenna horns is circular.

6. An angular-diversity radiating system in accordance with claim 1 wherein said constant cross section of said first part of said antenna horns is square.

7. An angular-diversity radiating system in accordance with claim 1 wherein said system is mobile.

8. An angular-diversity radiating system in accordance with claim 1, wherein said connection between said second adjustable antenna horn and said third and fourth wave guides include respective elastic sections which allow the adjusting movement of said second horn.

* * * * *